United States Patent [19]

Liu et al.

[11] Patent Number: 5,058,242

[45] Date of Patent: Oct. 22, 1991

[54] PEN HOLDER FOR A CLIP-BOARD

[76] Inventors: David Liu; Jane Keo, both of No. 95, Kung Cheng Rd., Taichung, Taiwan

[21] Appl. No.: 567,070

[22] Filed: Aug. 14, 1990

[51] Int. Cl.[5] ..... B42F 1/00

[52] U.S. Cl. ..... 24/67.7; 24/67 R; 281/45

[58] Field of Search ..... 24/11 PP, 11 CC, 11 R, 24/10 R, 67 R, 67.3, 67.5, 67.7, 67.11, 457; 281/30, 45

[56] References Cited

U.S. PATENT DOCUMENTS

| | | | |
|---|---|---|---|
| 2,160,392 | 5/1939 | Schade | 281/30 X |
| 3,085,777 | 4/1963 | Lewtan et al. | 24/67 R X |
| 3,105,279 | 10/1963 | Westhoff | 24/67.7 X |
| 3,246,914 | 4/1966 | Goodwin | 24/67.5 X |
| 3,517,636 | 6/1970 | Colon-Morales | 281/45 X |

*Primary Examiner*—James R. Brittain

*Attorney, Agent, or Firm*—Thomas S. Keaty

[57] ABSTRACT

A pen holder is adapted to be attached to a spring of a clip-board. The spring has a U-shaped portion. The pen holder has a recess for holding a pen. A notch and a pair of grooves are formed in the base portion for receiving the pivot axle and the legs of the U-shaped portion of the spring. The width of the base portion is arranged such that the pen holder can be retained in position by the engagements between the notch and the pivot axle and between the grooves and the legs of the U-shaped portion.

1 Claim, 2 Drawing Sheets

PEN HOLDER FOR A CLIP-BOARD

BACKGROUND OF THE INVENTION

The present invention relates to a pen holder, and more particularly to a pen holder for a clip-board.

Clip-boards have been used particularly by persons while standing and making sketches or notes, as well as for many other purposes, but while in use or being carried, the pencil or the like used to write on the sheets may be misplaced or lost.

U.S. Pat. No. 3,828,402 to Gorman discloses a device for a releasable gripping article. In this patent, a plurality of spring fingers are provided to grip the article or articles between the support member and spring fingers. The spring fingers may become fatigued when a large object is gripped between the support member and the spring fingers, or after a long term of using or being used frequently. In addition, the spring fingers may hurt the paper which is gripped between the support member and the spring fingers.

U.S. Pat. No. 3,105,279 to Westhoff discloses a clip board which has a pencil holding member provided thereon. In this patent, the pencil holding member and the clip member are biased by the same resilient member. The clip member is indirectly biased by the resilient member when a pencil is clamped by the pencil holding member so that the resilient force for clamping paper is small. In addition, when the pencil is clamped by the pencil holding member, the resilient member is prestressed and prestrained so that only few pieces of paper can be clamped by the clip member.

U.S. Pat. No. 4,896,927 to the applicants, David Liu and Jane Keo, discloses a combination clip-board and case. In this patent, a spring-like means is provided for receiving a pen. The spring-like means which is loosely attached to the clip may affect the making of the sketches or notes.

The present invention has arisen to mitigate and/or obviate the afore-described disadvantages of the conventional pen holders.

SUMMARY OF THE INVENTION

The primary objective of the present invention is to provide a pen holder detachably attached to a clip-board for holding a pen or the like.

In accordance with one aspect of the invention, there is provided a pen holder for a clip-board. A clip is pivotally coupled to the clip-board about a pivot axle and is biased by a spring which has a U-shaped portion. The pen holder has a base portion and a retaining portion formed together. A notch and a pair of grooves are formed in the base portion of the pen holder, the notch is provided for receiving the pivot axle and the grooves are provided for receiving two legs of the U-shaped portion. A recess is formed in the retaining portion for receiving a pen. The width of the base portion is arranged such that the pen holder can be retained in position by an engagement between the notch and the pivot axle and by another engagement between the grooves and the legs of the U-shaped portion.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
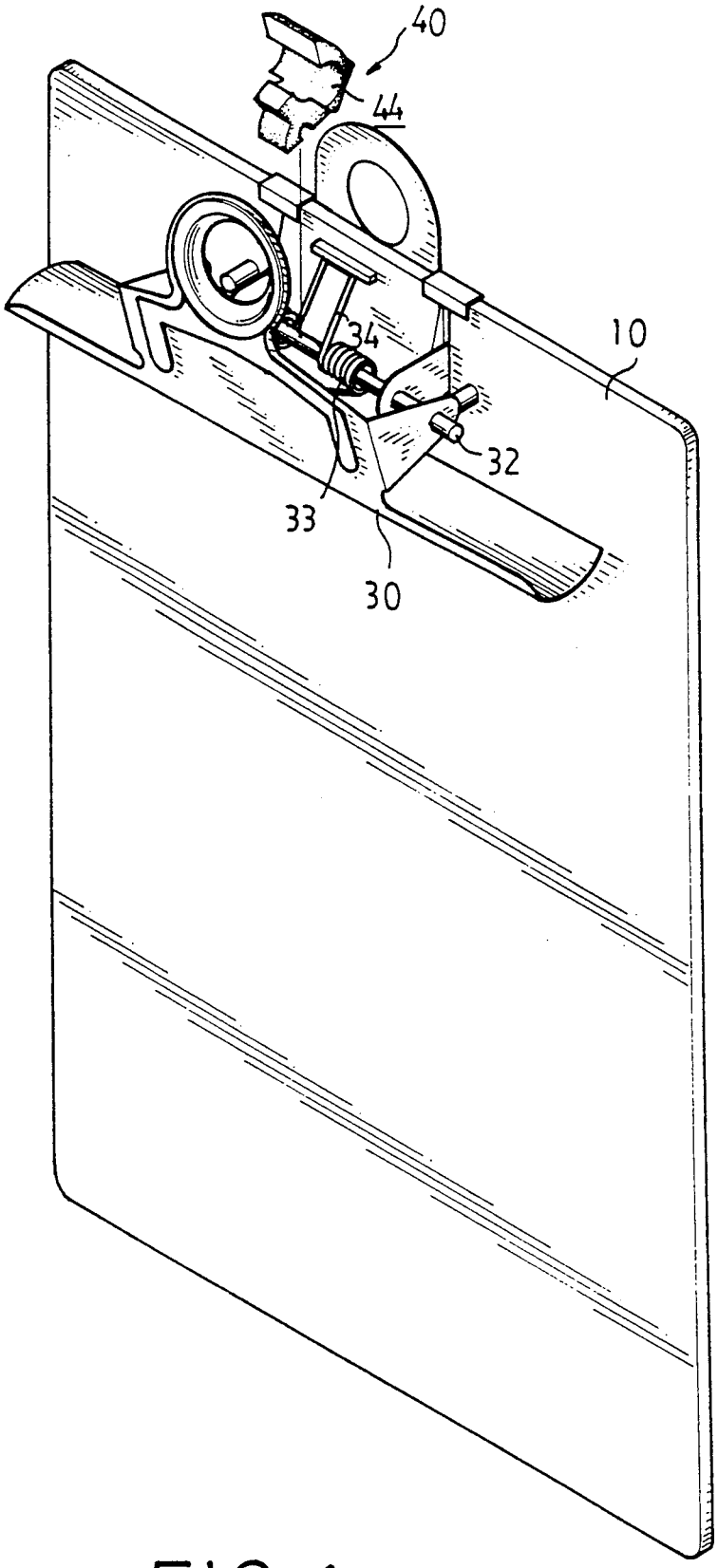
FIG. 1 is a perspective view of a pen holder in accordance with the present invention and a clip-board on which the pen holder is to be attached.

Referring to the drawings and initially to FIG. 1, the pen holder 40 in accordance with the present invention is generally provided to be attached to a clip-board 10 for holding a pen or the like. A clip 30 is pivotally coupled to the clip-board 10 about a pivot axle 32 and is biased by a spring member 33 which has a substantially U-shaped portion 34.

Figure 2:
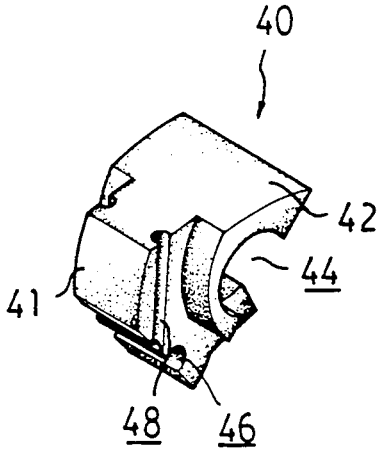
FIG. 2 is a perspective view of the pen holder viewing from a rear end thereof.

Referring next to FIG. 2, the pen holder 40 includes a base portion 41 and a retaining portion 42 integrally formed together. The base portion 41 has a width equal to or slightly larger than the distance between the two legs of the U-shaped portion 34 of the spring member 33. A notch 46 is laterally formed in the base portion 41 and is adapted for receiving and retaining the pivot axle 32. A pair of grooves 48 are formed in the base portion 41 and are substantially perpendicular to the notch 46. The grooves 48 are adapted for receiving and retaining the two legs of the U-shaped portion 34 of the spring member 33. A recess 44 is formed in the retaining portion 42 of the pen holder 40 and is adapted for holding or retaining a pen or the like.

Figure 3:
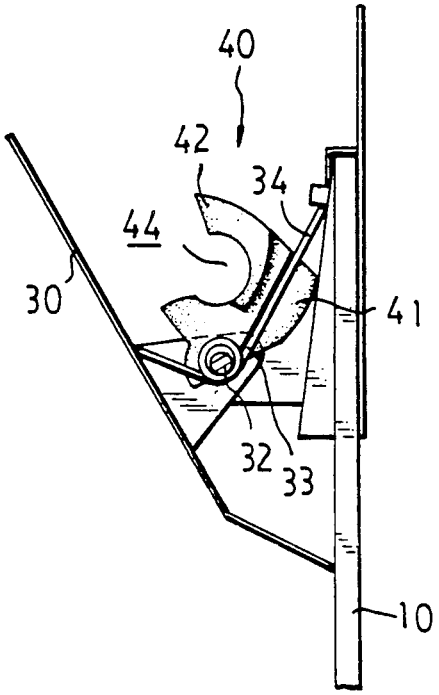
FIG. 3 is a side elevational view of the pen holder which is attached to the clip-board.

Referring next to FIG. 3, when the base portion 41 of the pen holder 40 is forced into the space between the two legs of the U-shaped portion 34 of the spring member 33, the pivot axle 32 is engaged in the notch 46 and the two legs of the U-shaped portion 34 are engaged in the grooves 48 so that the pen holder 40 can be clamped and retained in position. A pen or the like can be received and retained in the recess 44 of the pen holder 40 and can be protected by the clip 30.

Accordingly, the pen holder in accordance with the present invention can be easily attached to and detached from the spring member of the clip-board which has a U-shaped portion.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A clip-board comprising a clip pivotally coupled to said clip-board about a pivot axle and biased by a spring member which has a substantially U-shaped portion; a pen holder including a base portion and a retaining portion integrally formed together, a notch and a pair of grooves being formed in said base portion of said pen holder, said notch being provided for receiving said pivot axle and said grooves being provided for receiving two legs of said U-shaped portion of said spring member; a recess being formed in said retaining portion of said pen holder for holding a pen, and a width of said base portion being provided such that said pen holder can be retained in position by an engagement between said notch and said pivot axle and by another engagement between said grooves and said legs of said U-shaped portion of said spring member.

* * * * *